United States Patent [19]

Rüffer et al.

[11] Patent Number: 4,573,484

[45] Date of Patent: Mar. 4, 1986

[54] CHARGING DEVICE FOR OPENING AND DELIVERING LEAF-TYPE MATERIAL

[75] Inventors: Alfred Rüffer, Cologne; Peter Maubach, Brühl; Johannes Haas; Horst Quester, both of Cologne, all of Fed. Rep. of Germany

[73] Assignee: Wilh. Quester Maschinenfabrik GmbH, Hürth, Fed. Rep. of Germany

[21] Appl. No.: 642,445

[22] Filed: Aug. 20, 1984

[30] Foreign Application Priority Data

Jun. 14, 1984 [DE] Fed. Rep. of Germany ... 8418005[U]

[51] Int. Cl.[4] ..... A24B 3/06

[52] U.S. Cl. ..... 131/327; 131/304; 131/306

[58] Field of Search ..... 414/272, 300; 131/300, 131/304, 306, 327

[56] References Cited

U.S. PATENT DOCUMENTS 3,357,437 12/1967 Maguire ..... 131/304

3,838,698 10/1974 Dickinson ..... 131/304

4,222,397 9/1980 Brackmann et al. ..... 131/306

*Primary Examiner*—V. Millin

*Assistant Examiner*—H. Macey

*Attorney, Agent, or Firm*—Diller, Ramik & Wight

[57] ABSTRACT

A charging device for opening and delivering leaf-type material which includes a conveyor having an upper surface along which leaf-type material moves in a downstream direction of travel toward a discharge end, an opening mechanism adjacent the discharge end for establishing an arcuate path of travel along which a plurality of members move for intermittently successively underengagingly contacting and opening the leaf-type material during the movement thereof beyond the discharge end, and at least one mechanism downstream of the opening mechanism for establishing an arcuate path of travel along which a plurality of elements move for intermittently successively contacting and stripping, in opposition to the downstream direction of travel, the leaf-type material, and both the opening and stripping mechanisms being formed by a plurality of arcuately spaced elongated bars carried by end plates rotatable about associated axes in identical directions.

18 Claims, 5 Drawing Figures

CHARGING DEVICE FOR OPENING AND DELIVERING LEAF-TYPE MATERIAL

This invention is directed to a charging device for opening and delivering leaf-type material which is normally supplied in a compacted condition on an upper flight of an associated conveyor.

Leaf-type material, such as tobacco, tea or the like, is often compressed during its transport and storage, thereby requiring it to be opened prior to being processed. It is conventional to convey the compacted leaf-type material either continuously or intermittently on a conveyor to convey the leaflike material against a band carrying a multiplicity of spikes. The band is driven and the spikes engage the leaves or similar material and thereby remove the same from the compressed mass. However, since the spikes penetrate the leaves, the leaf-type material is not only opened (separated) from the compacted mass and carried away by the moving spiked band, but many of the leaves are damaged, broken, torn or disintegrated. Thus, due to this opening by a movable spiked band, the integrity of a great number of leaves is destroyed and they are unintentionally disintegrated during this opening phase. This automatically precludes the use of perforated or torn tobacco leaves for such purposes as the last wrapping on a cigar which must be imperforate, unbroken and aesthetic to the eye. Furthermore, another disadvantage of this type of mechanism is that due to the unequal material supply between the feed conveyor and the spiked band being fed thereby, there is formed so-called "tobacco rolls" which, by the repeated rotating of the tobacco flow, necessarily brings about an increased destruction of the leaves.

It is, therefore, a primary object of the present invention to provide a novel charging device for opening and delivering leaf-type material which ensures that the leaves are undamaged during the opening operation.

The present invention includes a charging device located at a discharge end of the conveyor upon which the leaf-type material is delivered in compacted or compressed form. The charging device includes at least one rotating means onto which the leaf-type material is shifted and which includes a number of opening or shaking members arranged eccentrically to an axis of rotation of the opening mechanism. These opening or shaking members engage the underside of the compacted material and during the rotation thereof, they intermittently successively underengagingly contact and open the leaf-type material during the movement thereof beyond the conveyor discharge end. Beyond the opening means or opening mechanism and further downstream thereof, there are a plurality of stripping elements extending transversely to the flow path of the material which likewise intermittently successively contact and strip the leaf-type material by operating thereagainst in opposition to the downstream direction of travel. The combined effect of the opening and stripping means or mechanisms is to fully open the leaf-type material in the absence of damage thereto or disintegration thereof for subsequent processing operations.

The effect of the charging device of the present invention is based upon the combination of the opening means or mechanism and the stripping means or stripper mechanism. Furthermore, both are driven rotatably and the respective opening or shaking members and stripping elements strike or impinge against the compressed leaf-type material in an intermittent alternating fashion, respectively, beneath and forwardly of the compacted material. Thus, the opening mechanism acting against the underside of the compacted mass of leaf-type material initiates the opening operation and in conjunction with the conveyor also now conveys the now opened leaves toward and against the opposing stripping elements which simply span the flow path of the leaf material. The stripper or stripping elements simply continue the opening operation and further open or spread leaves as the latter pass beyond the opening or shaking members of the opening mechanism. The latter occurs in the absence of leaf damage, destruction or disintegration, as would otherwise occur through the use of conventional spiked bands and is simply a normal progressive nonviolent opening operation without the leaves being pierced, torn or otherwise damaged or destroyed.

Preferably the charging device of the present invention is used for processing tobacco, but the same also lends itself to treating other leaf-shaped material, e.g., for opening and detaching tea leaves.

In accordance with the preferred embodiment of the invention, the opening mechanism includes a plurality of shaking or opening members which are round in cross-section and have ends fastened to end plates which are in turn mounted for rotation about an axis of rotation which is normal to the direction of travel of the leaf-type material. Thus, the shaking or opening members or bars move along a circular path of travel, and preferably there are at least two bars per opening mechanism. Furthermore, there are preferably two such opening mechanisms in side-by-side relationship with the bars of the adjacent opening mechanisms being mutually offset by 180° of arc. Thus, as one bar of one opening mechanism reaches its apogee and engages the underside of the compacted material, a shaking bar of the other opening mechanism is not in contact with the underside of the contacted material and does not so underengage the undersurface of the contacted material until the first-mentioned bar has passed therebeyond. Thus, the shaking members or bars of the adjoining opening mechanisms alternately contact the underside of the compacted mass in an intermittent successive fashion to open the compacted leaf-type material. During the same successive intermittent and alternating contact, the material is lifted and lowered causing a bouncing action to be imparted to the compacted material creating shocks therein which further causes its opening. Thus, in addition to the mechanical opening effected simply by the contact of the opening bars there is also a vibratory action established in the compacted material resulting in the opening thereof.

In order to prevent the peripheral surfaces of the bars which bear against the leaves from acting frictionally thereagainst in a manner which might cause abrasion or tearing of the leaves, the bars are preferably pivoted or rotated in the end plates. Thus, the shaking bars or members freely rotate as they contact the compacted material and this also assures that the leaves are undamaged during the opening operation.

Downstream of the opening mechanism or mechanisms the stripping or stripper mechanism is deposed across the width of material flow and similarly includes a plurality of stripping elements or bars mounted between end plates which are rotated about an axis normal to the direction of material travel upon the conveyor. However, these stripper or stripping elements are positioned at least partially above, and at times totally above, the apogees of the opening bars of the opening mechanisms and in opposed relationship to the direction of movement of the compacted material upon the conveyor. Thus, the stripping elements act on the leading or front face of the compacted material flow and strips off those leaves which have not yet been previously opened or removed from the compacted mass of leaves. The stripping bars are not necessarily parallel to the axis of rotation but may be oblique thereto, i.e., a course having a circumferential component. The position of the stripping bars is, however, such as to act on the forward moving or facing end of the compacted material flow without striking against the leaf stock but instead moving thereagainst in a somewhat tangential stripping path or course which further opens or strips the leaves in a continuous nondestructive manner.

In accordance with a preferred embodiment of the invention, the opening bars and stripping bars of the opening and stripping mechanisms are driven synchroneously and in the same direction, although the bars thereof are preferably mutually angularly offset to achieve the alternating intermittent contacting relationship heretofore described. Furthermore, this mutual offset of the bars is such that at any one moment of relative rotation, one shaking bar or one stripping bar at a maximum is at its least distance to the adjacent stripping bar or opening bar. Thus, no shaking bar and an associated stripping bar will never be spaced from each other a minimum distance, and this assures that none of the leaf material will be compacted between adjacent arcuately moving bars of adjacent stripping and opening mechanisms.

While in the preferred embodiment of this invention, the opening mechanisms preferably act discontinuously and intermittently, though successively, on the underside of the compacted material, the stripping mechanism and particularly the stripping bars thereof operate continuously and in a shock-free manner against the leading face of the compact material. To the latter end each stripping bar between the end plates has a circumferential portion which is circumferentially or peripherally outboard of a line passing through the ends of this bar. In other words, each stripping bar has opposite aligned ends and a mid-portion therebetween which is circumerentially outbard of this line and is generally in the center of each stripping bar. This center stripping bar portion prevents axial forces from acting on the stripper bar, as might also be accomplished by simply forming a helix from each stripper bar between the opposite end plates of the stripping mechanism.

With the above and other objects in view that will hereinafter appear, the nature of the invention will be more clearly understood by reference to the following detailed description, the appended claims and the several views illustrated in the accompanying drawings.

Figure 1:
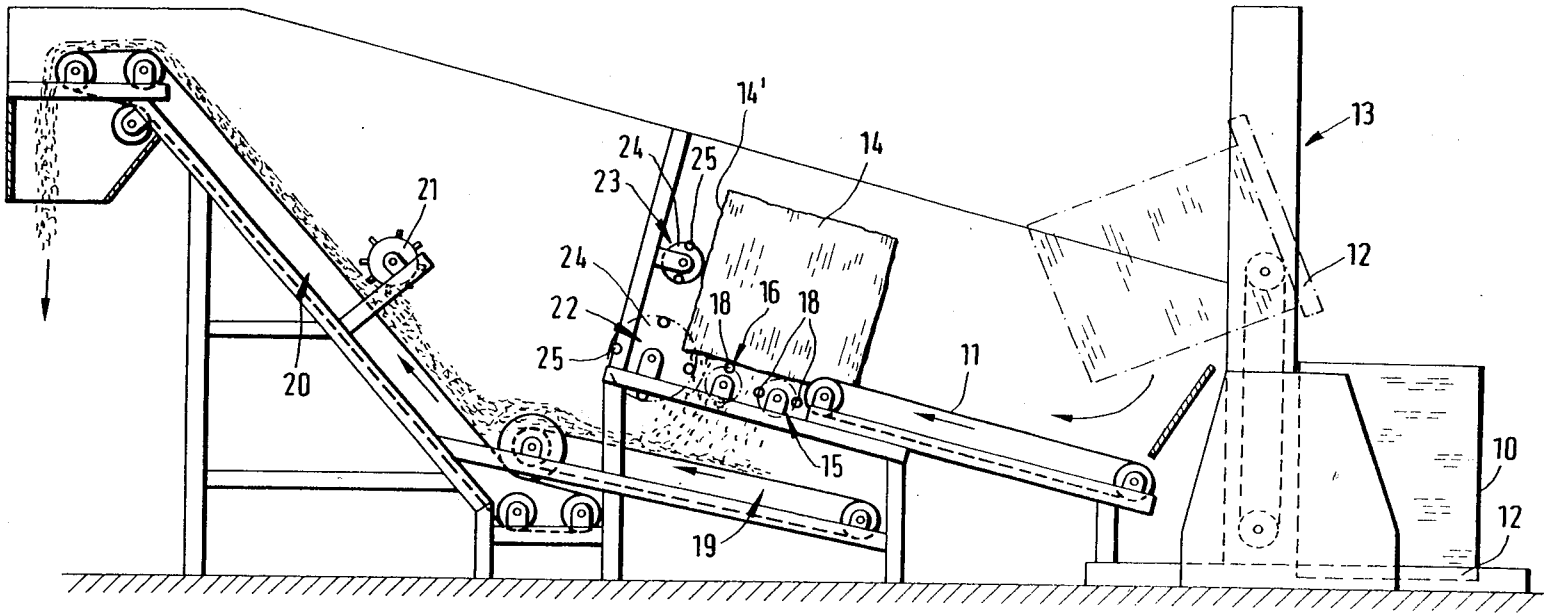
FIG. 1 is a side elevational view of a novel charging device for opening and delivering leaf-type material in accordance with this invention, and illustrates a conveyor delivering a block of compact leaf-type material upon a pair of opening mechanisms and toward a pair of stripping mechanisms.

Reference is now made to FIG. 1 of the drawings which illustrates a charging device for opening and delivering compacted leaf-type material, such as tobacco or tea leaves, which is normally housed in cases 10 and removed therefrom as a compacted block 14 of leaf-type material which is deposited upon the conveyor 11 by a conventional lifter or lifter frame 13. The case 10 is simply positioned a platform 12 of the lifter frame 13, the platform 12 is conveyed upwardly by a chain drive mechanism (unnumbered) and thereafter the platform 12 is tilted, as indicated in phantom outline position in FIG. 1. The block of compact leaf-type material 14 is then dumped upon the upper run (unnumbered) of the conveyor 11 and transported thereby in a downstream direction of travel which is toward the left in FIG. 1 toward a discharge end (unnumbered) of the conveyor 11. The block or leaf-type compacted material 14 is so delivered to the conveyor 11 that the horizontal position of the leaf layers in the cases 10 when initially placed upon the platform 12 (solid lines in FIG. 1) becomes disposed in a vertical plane when on the upper run of the conveyor 11. In other words, the lateral edge of the block 14 is supported on the upper run (unnumbered) of the conveyor 11 which places the leaves with their planes disposed generally vertically or normal to the upper flight of the conveyor 11.

Figure 2:
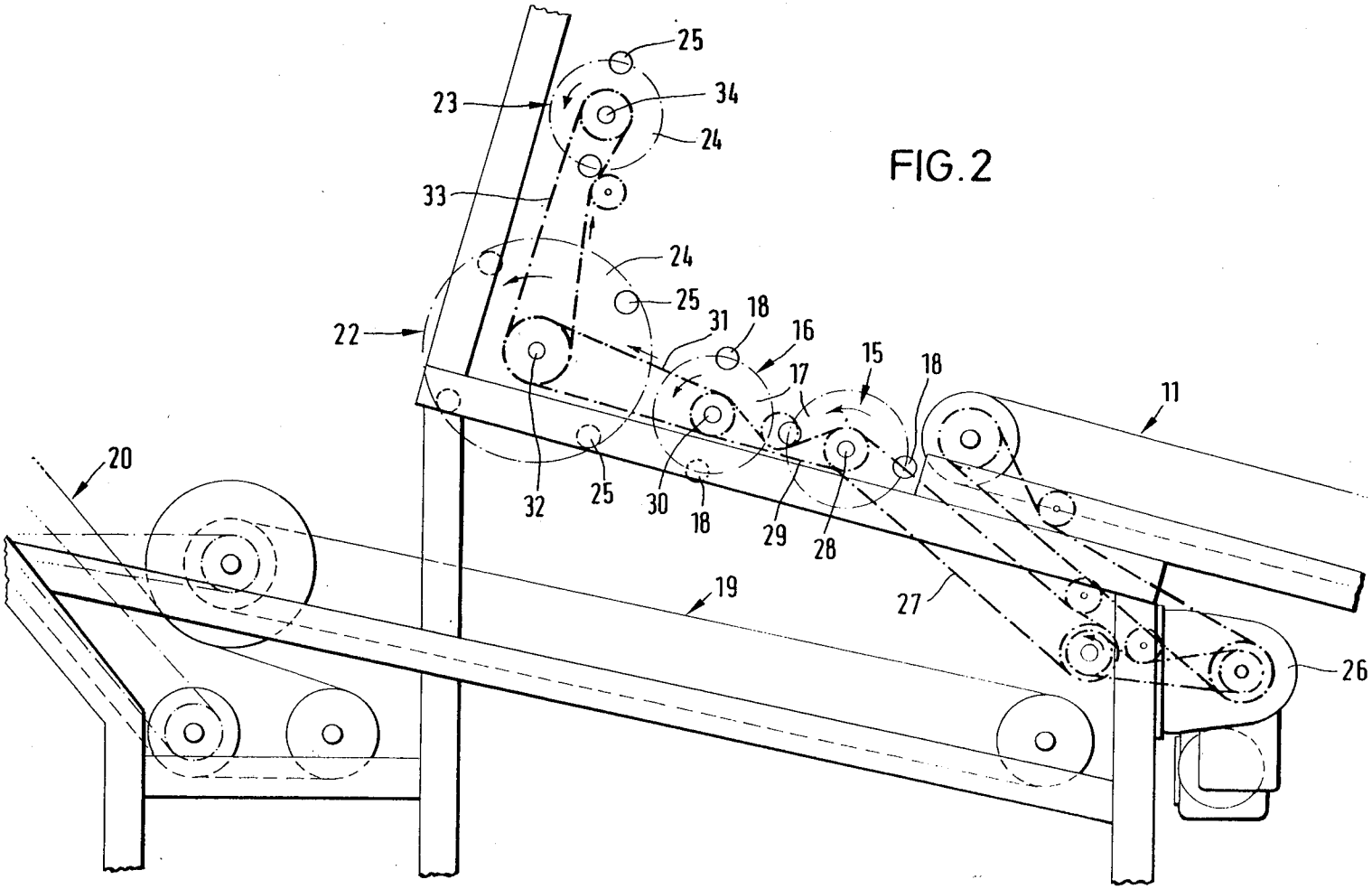
FIG. 2 is a schematic view of the drive mechanisms of the opening mechanisms and the stripping mechanisms of the charging device of FIG. 1.

The conveyor 11 is preferably a trough-like type conveyor which is slightly inclined upwardly in the direction of travel, as is evident from FIGS. 1 and 2 of the drawings. Slightly downstream of the discharge end (unnumbered) of the conveyor 11 there are provided two generally identical means 15, 16 for establishing an arcuate path of travel along which a plurality of members 18 thereof move for intermittently successively underengagingly contacting and opening the leaf-type block of compact material 14 during the movement of the latter beyond the discharge end of the conveyor 11. The opening means or opening mechanisms 15, 16 are identical, and each includes two end plates 17 between which extend the opening or shaking elements 18 which are preferably formed by cylindrical bars (circular cross-section) mounted in parallel relationship to each other and to axes of the plates 17 established by shafts 28, 30 (FIG. 2) secured thereto. Preferably the ends of the shaking or opening members or bars 18 are freely rotatably or pivotally mounted relative to the end plates 17 so that they nonfrictionally engage and, thus, relatively freely rotate with respect to the compact material 14. The shaking or opening members or bars 18 of each opening mechanism 15, 16 is offset by 180° along their circular or arcuate path of travel. Moreover, the shaking or opening members 18 of the opening mechanism 15 are offset by 90° relative to the shaking members or bars 18 of the opening mechanisms 16. The latter construction is clearly evident in FIGS. 1 and 2 and because of this 90° offset only one shaking bar at a time in a successive intermittent fashion will contact the underside (unnumbered) of the compact block 14 of leaf-type material, as is indicated in FIG. 1, noting that one of the opening bars 18 of the opening mechanism 16 at its apogee is contacting the underside of the block 14 whereas the remaining shaking bar 18 thereof and the two shaking bars 18, 18 of the opening mechanism 15 are not in contact with the underside of the block 14. However, as the opening mechanisms continue to operate, the shaking bar 18 of the opening mechanism 16 at its apogee moves away from the noon position in a counter-clockwise direction whereas the shaking bar 18 at the three o'clock position of the opening mechanism 15 moves counter-clockwise toward the noon position. The latter motion is repeated to bring the bars 18 of the opening mechanisms 15, 16 intermittently and successively into underengaging contact with the leaf-type material 14 resulting in the opening or spreading of the leaves thereof. The same intermittent contacting action also vibrates the block 14 through a successive lifting and lowering thereof by the opening mechanisms 15, 16, and this vibration also assists in the opening of the leaves of the block 14. Thus, the continuing contact of the shaking bars 18 with the leaves and the vibration or shock created in the block 14 results in the leaves to be opened or removed from the mass of compact material or block 14 and eventually dropped onto a conveyor 19 for transport to a slope conveyor 20 on which the leaves are carried in separated loose opened form. In order to obtain a uniform layer of material thickness upon the slope conveyor 20, a trimming roll 21 which may be provided with spikes and which counter-rotates relative to the direction of material flow, is provided above the slope conveyor 20 (FIG. 1).

The block or compact mass of material 14 includes a leading or forward face or side 14' which moves toward and against two generally identical stripping means or mechanisms 22, 23 which are downstream of the opening means 15, 16 and similarly establish an arcuate path of travel along which a plurality of stripping elements 25 move for intermittently successively contacting and stripping, in opposition to the downstream direction of travel, the leaf-compacted material 14. The stripper or stripping elements 25 are preferably formed by cylindrical bars which are generally round in cross-section and are in parallel relationship to each other and to axes of rotation defined by shafts 32, 34 (FIG. 2) of the respective stripping mechanisms 22, 23. The stripping mechanism 22 includes four stripping elements 25 distributed at equal angular distances of 90° from each other, while the stripping mechanism 23 is of a smaller diameter and includes only two stripping elements 25 offset from each other by 180°. Preferably, the stripping elements 25 of both stripping mechanisms 22, 23 are pivotably or rotatably mounted in lateral end plates 24.

The apogee of the path of travel of the stripping mechanisms 22 is above the apogee of the paths of travel of the opening mechanisms 15, 16, and as the stripping mechanism 22 rotates in a counter-clockwise direction (FIGS. 1 and 2), the individual stripping bars 24 move generally tangentially upwardly relative to the forward face 14' of the block 14 resulting in a stripping action being applied to the generally vertically disposed leaves thereof. Similarly, the stripping mechanism 23 during its counter-clockwise rotation, again as viewed in FIGS. 1 and 2, includes a tangential reaction force which acts against the faces of the leaves of the block 14 resulting in a stripping or opening action thereagainst at the block 14 moves to the left under the influence of the conveyor 11.

The drives for the opening means 15, 16 and the stripping means 22, 23 is fully illustrated in FIG. 2, and includes an electric motor 26 which also drives the conveyor 11. The motor 26 also drives the shaft 28 of the first opening mechanism 15 through a chain 27. Another chain 29 is driven by the shaft 28 and in turn drives the shaft 30 of the second opening mechanism 16. A chain 31 is driven by the shaft 30 and in turn drives the shaft 32 of the stripper mechanism 24. A fourth chain 23 is driven by the shaft 32 to drive the shaft 34 of the stripper mechanism 23. The direction of rotation of the opening mechanisms 15, 16 and the shaking mechanisms 22, 23 are all counter-clockwise, as is indicated by the unnumbered headed arrows associated therewith in FIG. 2. Therefore, the opening direction of motion is successively leftward, as viewed in FIG. 1, along the bottom of the block 14 from the opening mechanism 15 toward the opening mechanisms 16 and from the opening mechanism 16 toward the stripping mechanism 22 at which there is an upward transition of the shaking motion toward and including continued upward motion by means of the shaking mechanisms 23. In this fashion, the leaves are substantially opened, if not entirely opened, by the opening mechanisms 15, 16, but any leaves which are not opened or striped from the block 14 are further opened and/or stripped therefrom by the stripping mechanisms 22 and 23.

The diameter of the stripping mechanism 22 is approximately double that of the diameters of the opening mechanisms 15 and 16 and that of the upper stripping mechanism 23. As is evident from FIG. 1, the circular paths of travel of the stripping elements 25 extends upwardly beyond the circular paths of the opening mechanisms 15, 16, thus causing the stripping mechanism 22 to predominantly engage the lower front edge of the block 14 while the upper stripping mechanism 23 is processing the block 14 nearly at the center of its height.

Figure 3:
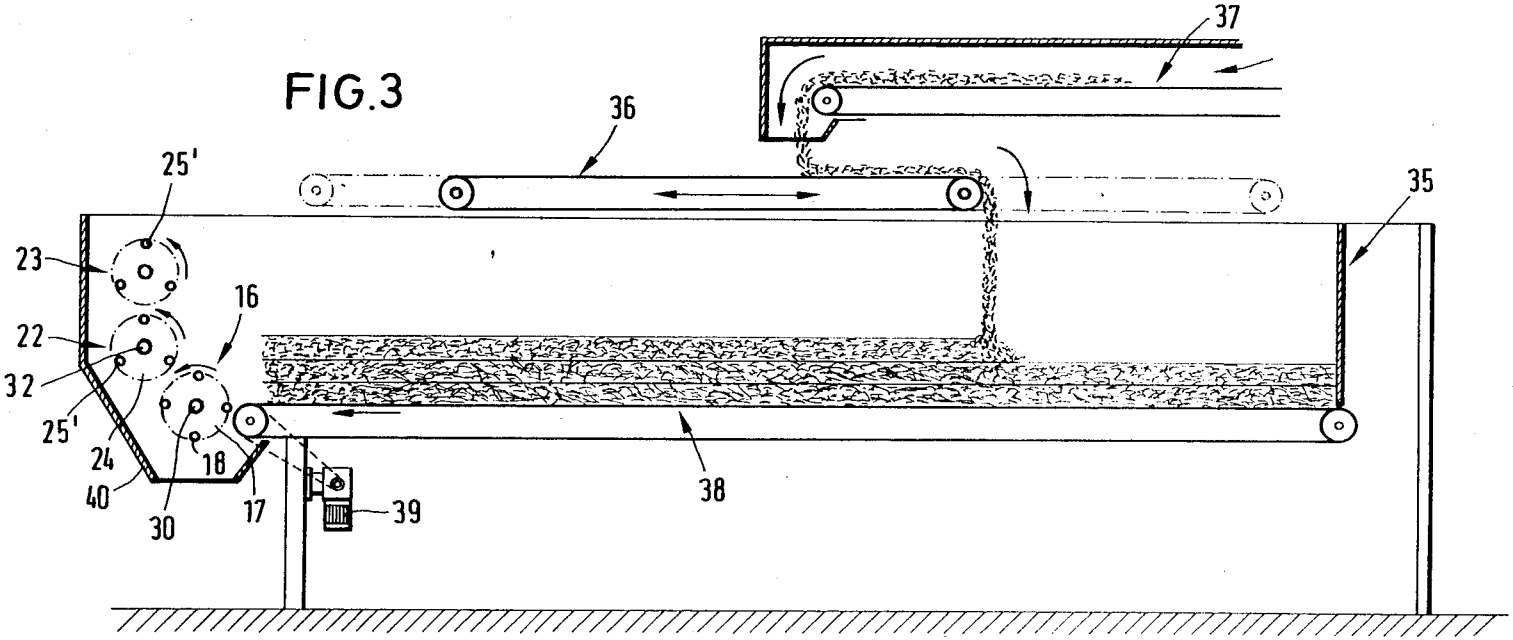
FIG. 3 is a longitudinal cross-sectional view of an accumulator box, and illustrates a charging device associated therewith for opening and delivering compact leaf-type material.
Figure 4:
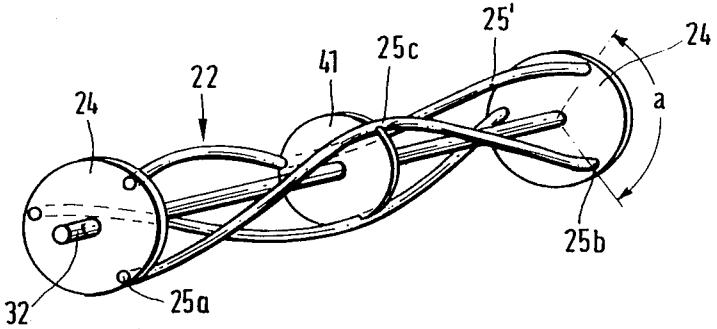
FIG. 4 is a perspective view of one of the stripping mechanisms of FIG. 3, including a plurality of undulating stripping bars thereof.
Figure 5:
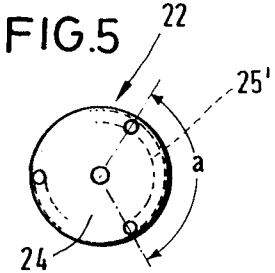
FIG. 5 is a front elevational view of the stripping mechanism of FIG. 4.

Reference is now made to FIGS. 3 to 5 of the drawings which illustrate a mixing, storing or accumulating box 35 which also incorporates therein the charging device of the present invention for opening and delivering compact leaf-type material. The accumulating box 35 includes an elongated trough (unnumbered) opened at it top and above which there is a distributing conveyor 36 which is displaceable longitudinally in a conventional manner, as is indicated by the unnumbered double-headed arrows associated therewith. By continuously reciprocating or displacing the distributing conveyor 36 above the accumulating box 35 several layers of tobacco are superimposed upon each other in a compact fashion, as is clearly evidenced from FIG. 3.

The bottom of the accumulating box 35 is formed by a conveyor 38 which includes an upper flight driven to the left, as viewed in FIG. 3, by a conventional motor 39 and appropriate drive gearing (unnumbered). The compact material atop the upper run of the conveyor 38 moves toward a discharge end (unnumbered) of the conveyor 38, and immediately adjacent thereto is opening means 16 corresponding identically to that heretofore described excepting of slightly larger overall diameter, and the two superposed stripping means 22, 23, again identical to the stripping means 22, 23 heretofore described relative to FIG. 1 except for being of the same diameter and varying somewhat with respect to the construction of stripping elements or bars 25' (FIGS. 4 and 5) which will be described more fully hereinafter.

The opening means or opening mechanism 16 of FIG. 3 includes two parallel rotating end plates 17 between which extend four shaking or opening members or bars 18 disposed parallel to the shaft 30. The bars 18 are preferably pivoted or mounted for rotation relative to the plates 17. The opening means or mechanism 16 also projects beyond and above the upper flight of the conveyor 38 which during the rotation thereof in a counterclockwise direction imparts lifting and opening movement to the compact tobacco layers in the same intermittent successive underengaging and upwardly moving relationship heretofore described relative to FIG. 1.

Reference is now made to FIGS. 4 and 5 of the drawings in which the stripping bars 25′ of both stripping mechanisms 22, 23 are illustrated, noting that there are three stripping elements or bars 25′ spanning the lateral end plates 24, 24 and having ends 25*a* and 25*b* rotatably mounted therein. The ends 25*a*, 25*b* are on a coincident axis or are aligned with each other whereas a mid portion therebetween is bent or curved circumferentially and secured to a support plate 41 positioned generally between the end plates 24, 24. Thus, half the length of each stripping bar 25′ extends over an angle "a" of 120° in the peripheral or circumferential direction of the stripping mechanism 22 or the end plates 24 thereof whereas the other half of the length of each stripping bar 25′ extends backward over the same angle. Thus, the point 25*c* of the arc of each stripping bar 25′ is at a point most remote from the ends 25*a*, 25*b* of each bar 25′, and this assures that with each rotary position of each stripping mechanism 22 (or 23), one stripping element 25′ engages the front side of the material flow and the stripping mechanisms 22, 23 are prevented from impacting against the front or leading side of the material falling upon the conveyor 38. As a result of the illustrated bent stripping bars 25*c*, it is inhibitive for the tobacco flow to apply axial forces on the stripping mechanisms 22, 23.

Although in a preferred embodiment of the invention as has been specifically illustrated and described herein, it is to be understood that minor variations may be made in the apparatus without departing from the spirit and scope of the invention, as defined in the appended claims.

What is claimed is:

1. A charging device for opening and delivering leaf-type material comprising a conveyor, said conveyor having a discharge end, means for imparting movement to said conveyor to convey leaf-type material in a downstream direction of travel toward said discharge end, at least one means adjacent said discharge end and underneath the leaf-type material for establishing an arcuate path of travel along which a plurality of members move for intermittently successively underengagingly contacting and opening the leaf-type material during the movement thereof beyond said discharge end, and at least one means downstream of said opening means for establishing an arcuate path of travel along which a plurality of elements move for intermittently successively contacting and stripping, in opposition to the downstream direction of travel, the leaf-type material.

2. The charging device as defined in claim 1 wherein the arcuate path of travel of said opening means includes an apogee disposed at a level above an upper conveyor surface of said conveyor.

3. The charging device as defined in claim 1 wherein said opening means are rotatable about an axis, and said opening members are radially offset from said axis.

4. The charging device as defined in claim 1 wherein said stripping elements extend transversely to the downstream direction of travel.

5. The charging device as defined in claim 1 wherein the arcuate path of travel of said opening means includes an apogee disposed at a level above an upper conveyor surface of said conveyor, said opening means being rotatable about an axis, said opening members are radially offset from said axis, and said stripping elements extend transversly to the downstream direction of travel.

6. The charging device as defined in claim 5 wherein said opening members are relatively straight bars which span between end plates, and said straight bars extend transverse to the downstream direction of travel.

7. The charging device as defined in claim 5 wherein said opening members are relatively straight bars which span between end plates, said straight bars extend transverse to the downstream direction of travel, and said straight bars are pivoted at said end plates.

8. The charging device as defined in claim 5 wherein said conveyor is of a width defining a predetermined width of material flow, and said stripping elements are bars which extend over the width of material flow.

9. The charging device as defined in claim 5 including means for synchronously driving said opening means and said stripping means, said opening member being spaced a predetermined arcuate distance from each other along the associated arcuate path of travel, said stripping elements being spaced a predetermined arcuate distance from each other along the associated arcuate path of travel, said paths of travel being disposed adjacent each other and said opening members and stripping elements being in mutually offset relationship to each other such that at any moment during travel along said paths of travel only one opening member and one stripping element are at a minimum distance from each other.

10. The charging device as defined in claim 5 wherein each stripping element extends at least partially circumferentially.

11. The charging device as defined in claim 5 wherein stripping elements are elongated bars of a predetermined length between opposite ends, said opposite ends are coincident to a line parallel to an axis of said opening means path of travel, and a portion of each of said stripping bars are circumferentially offset from said line.

12. The charging device as defined in claim 5 wherein each of said establishing means further establishes identical directions of travel of the associated arcuate paths of travel.

13. The charging device as defined in claim 5 including a further opening means between said one opening means and said stripping means for establishing a further arcuate path of travel along which a further plurality of members move for intermittently successively underengagingly contacting and further opening the leaf-type material during the movement thereof beyond said one opening means, said further arcuate path of travel includes an apogee disposed at a level above said upper conveyor surface, said further opening means being rotatable about an axis, said further opening members being radially offset from said last-mentioned axis, and said opening members and further opening members being offset by 90°.

14. A charging device for opening and delivering leaf-type material comprising a conveyor, said conveyor having a discharge end, means for imparting movement to said conveyor to convey leaf-type material in a downstream direction of travel toward said discharge end, at least one means adjacent said discharge end and underneath the leaf-type material for intermittently successively underengagingly contacting and opening the leaf-type material from beneath during the movement thereof beyond said discharge end, and at least one means downstream of said opening means in opposition to the downstream direction of travel for stripping the leaf-type material.

15. The charging device as defined in claim 14 wherein said opening means establishes an arcuate path of travel having an apogee disposed at a level above an upper conveyor surface of said conveyor.

16. The charging device as defined in claim 14 wherein said opening means are a plurality of members movable along an arcuate path of travel by rotation about an axis, and said opening members are radially offset from said axis.

17. The charging device as defined in claim 14 wherein said opening means establishes an arcuate path of travel having an apogee disposed at a level above an upper conveyor surface of said conveyor, said opening means are a plurality of members movable along an arcuate path of travel by rotation about an axis, and said opening members are radially offset from said axis.

18. The charging device as defined in claim 17 wherein said opening members are a plurality of bars.

* * * * *